US006745684B1

(12) United States Patent
Zimmer et al.

(10) Patent No.: US 6,745,684 B1
(45) Date of Patent: Jun. 8, 2004

(54) PRINTING DEVICE OR PRINTING METHOD

(75) Inventors: Michael Zimmer, Saarbrücken (DE); Bernd Schultheis, Schwabenheim (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/049,489

(22) PCT Filed: Aug. 11, 2000

(86) PCT No.: PCT/EP00/07819

§ 371 (c)(1),
(2), (4) Date: Jul. 17, 2002

(87) PCT Pub. No.: WO01/12445

PCT Pub. Date: Feb. 22, 2001

(30) Foreign Application Priority Data

Aug. 13, 1999 (DE) ..... 199 38 447

(51) Int. Cl.[7] ..... G03G 15/16; B41M 1/34

(52) U.S. Cl. ..... 101/35; 101/41; 101/489; 101/492; 101/DIG. 37; 347/154; 399/302

(58) Field of Search ..... 101/33, 34, 35, 101/36, 41, 44, 492, 489, DIG. 37, 487, 488, 171, 211; 399/299, 302; 347/115, 117, 154

(56) References Cited

U.S. PATENT DOCUMENTS 4,144,808 A * 3/1979 Iwasa et al. ..... 101/494
4,187,774 A * 2/1980 Iwasa et al. ..... 101/494
4,217,819 A * 8/1980 von Tluck et al. ..... 347/153
5,216,453 A * 6/1993 Itoh ..... 347/112
5,988,068 A * 11/1999 Van Ritter et al. ..... 101/488
6,477,349 B2 * 11/2002 Kanekura et al. ..... 399/302

FOREIGN PATENT DOCUMENTS

| | | | |
|---|---|---|---|
| EP | 647 885 | | 4/1995 |
| EP | 727 778 | | 8/1996 |
| EP | 834 784 | | 4/1998 |
| JP | 8-146819 | * | 6/1996 |

* cited by examiner

*Primary Examiner*—Leslie J. Evanisko
(74) *Attorney, Agent, or Firm*—Pauley Petersen & Erickson

(57) ABSTRACT

A printing method using at least one transfer roller, whose roller surface is charged with a coating material, for example a toner. The coating material is directly or indirectly transferred from the transfer roller to a support surface of a transfer element, before being transferred at least partially from the transfer element to a workpiece to be coated. According to this invention, the transfer element has a stretching element which forms the support surface and the support surface is stretched in the direction of the surface by a stretching device. This ensures that this method can also be used to easily coat 3-dimensional surfaces which are curved in space.

17 Claims, 1 Drawing Sheet

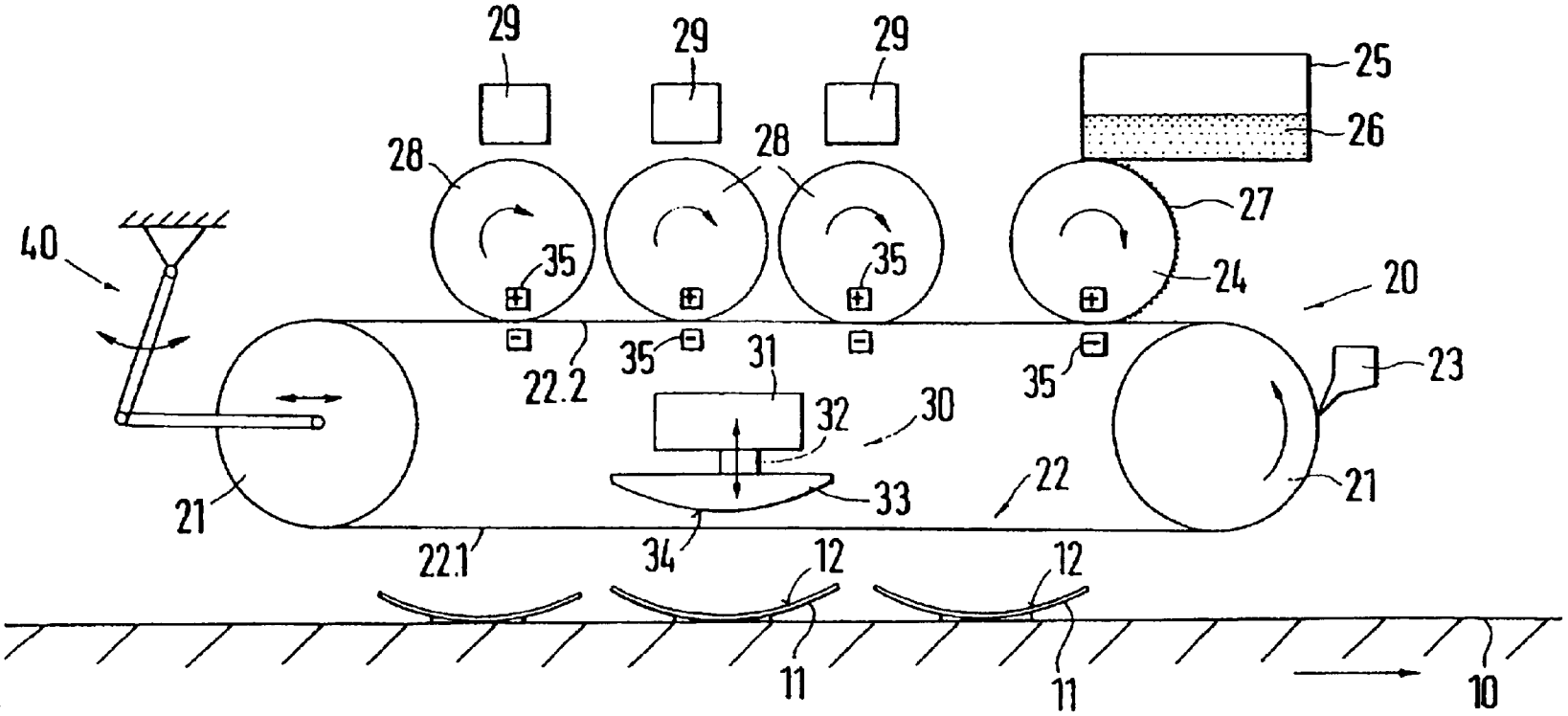
10
11
12
20
21
22
22.1
22.2
23
24
25
26
27
28
29
30
31
32
33
34
35
40

PRINTING DEVICE OR PRINTING METHOD

This application is a 371 of PCT/EP00/07819, filed Aug. 11, 2000.

BACKGROUND OF THE INVENTION

1. Field of the Invention

This invention relates to a printing device with at least one transfer roller having a surface that can be charged at least partially with a coating material, for example toner, wherein the coating material can be applied indirectly or directly to a carrier surface of a transfer element.

This invention also relates to a printing method wherein a coating is applied to a workpiece using a transfer element.

2. Description of Related Art

A coating method is known from European Patent Reference EP 0 647 885 A1, which is used for imprinting ceramic and glass products. A toner is employed, with toner particles that have a pigment core, the toner particles consisting of ceramic pigments and glassy flux surrounded by a binder resin envelope. Charge control means are coupled to the binder resin envelope. The toner particles are applied to a paper coated with gum arabic with the aid of an electrostatic copying process. A clear lacquer is applied to the coated paper for fixation. The paper can subsequently be placed on a workpiece to be coated, such as a ceramic or glass product, and can be moistened. The paper used as the transfer means can be pulled off, while the gum arabic layer and the colored coating applied to it adhere to the workpiece.

A firing process is performed at the end, wherein the ceramic coloring melts together with the surface of the ceramic or glass product. With this method it is possible to create high quality and scratch-proof coatings.

Furthermore, a printing device is known from European Patent References EP-OS 0 834 784 and EP-OS 0 727 778, which has a tape-like transfer device with a flexible tape with a silicon coating. This tape is pressed against the workpiece by a roller in the area of the transfer of the toner, however, a coating of two-dimensional surfaces is not possible.

SUMMARY OF THE INVENTION

It is one object of this invention to provide a coating device, or a coating method, by which it is possible in a simple way to also coat three-dimensional surfaces in particular, which are curved in space.

The object is achieved with a transfer element that has an expansion element forming the carrier surface, and the carrier surface can be expanded by an expansion device.

The expansion element can be deformed with the expansion device so that it is adapted to the contour of the surface to be imprinted. In a simple way it is possible to also imprint complex courses of three-dimensionally shaped surfaces.

For example, the printing method, or the printing device, is suitable for workpieces made of glass, glass ceramics, ceramics, or plastic which are deformed out of the plane. In particular, three-dimensionally shaped parts are now made of the above mentioned materials and cannot easily be printed cost-effectively by known screen-printing techniques. It is possible with the printing method, or the printing device, to imprint three-dimensionally deformed glass panels, for example curved front panels of ovens, operating panels made of glass, glass doors for furniture or curved architectural glass, three-dimensionally deformed cooking surfaces made of glass ceramics with, for example, lower located cooking areas, or higher located operating areas formed out of the plane, as well as curved fireplace viewing panels, three-dimensionally deformed ceramic parts, for example tableware pieces such as plates and dishes, and three-dimensionally deformed plastic surfaces.

In one embodiment of this invention the transfer element is designed as an endless revolving tape, which has along its longitudinal extension at least partially expansion elements, or is designed as an expansion element itself.

The endless tape allows a continuous efficient coating of workpieces. Thus the transfer element is embodied as a rubber tape.

For example, the printing device can be designed so that the expansion device has a die, the die has a die face which is embodied so that it is matched to the surface to be imprinted of the workpiece. The carrier surface of the expansion element can be pushed out of its expanded initial position against the surface to be imprinted by the die. Here, the die stretches the expansion element. However, it is also possible for the carrier surface of the expansion element to be pressed on the workpiece using compressed air or by the action of a vacuum.

In order to prevent the damage of delicate workpieces, in particular brittle and fragile workpieces of glass, glass ceramics or ceramics, during the printing process, the die face of the die can be made from an elastic, resilient material.

So that no coating material is spread between two printing processes, a cleaning arrangement is assigned to the transfer element, by which the carrier surface of the expansion element can be cleaned after the printing process.

It is also possible for the carrier surface of the expansion element to have a silicon coating or to be formed by silicon rubber. Such an embodiment of the surface prevents coating material from adhering to the carrier surface after the printing process.

If workpieces are continuously fed to the printing device, for example by a conveyor belt, the printing process can be designed so that the transfer element, which circulates as an endless tape, is routed past the expansion device. The endless tape can be stopped during the expansion of the carrier surface and the performance of the printing process. The conveyor belt can be stopped simultaneously with the cycling of the endless tape.

A continuous production process can be achieved if the transfer element circulating as an endless tape is conducted past the expansion device. During the extension of the carrier surface and the execution of the printing process the expansion device, and simultaneously the workpiece, are conducted along with the endless tape.

In one embodiment of this invention, a corona device is assigned to the expansion device, which causes or aids the transfer of the coating material to the printing surface of the workpiece to be imprinted.

BRIEF DESCRIPTION OF THE DRAWING

This invention is explained in greater detail in view of an exemplary embodiment represented in a schematic view in the drawing.

DESCRIPTION OF PREFERRED EMBODIMENTS

The drawing shows a printing device in a schematic representation, to which workpieces 11 are continuously fed by a conveying device 10. The workpieces 11 are predominantly embodied as plates, which have a surface 12 to be imprinted which faces upward. The purpose is to imprint the surface 12 to be imprinted with the printing device, which will be described in detail. Without limiting the general concept, the workpieces 11 can also be different, already previously described workpieces made of glass, glass ceramics or plastic.

The printing device has a first transfer roller 24, which can be electrostatically charged in a known manner and then coated with toner particles 27 of a toner 26. The toner 26 is kept in a reservoir 25. In the present embodiment, black-colored toner 26 is stored in the reservoir 25. Three further transfer rollers 28 are provided in addition to the transfer roller 24. Further reservoirs 29 are assigned to the transfer rollers 28. Colored toner is placed into the individual reservoirs 29. The transfer rollers 28 can be coated with these colored toners.

A transfer device 20 is arranged underneath the transfer roller 24 and 28. The transfer device 20 has an endless tape embodied as an expansion element. Here, the endless tape 22 is embodied as a rubber tape. The rubber tape 22 is reversed over two conveying rollers 21, which are maintained at a distance from each other. The left one of the two conveying rollers 21 is driven by a motor, not represented in the drawing. Accordingly, the rubber tape 22 forms an upper oncoming strand 22.2 and a lower departing strand 22.1. A tightening unit 40 is also assigned to the left conveying roller 21. The rubber tape 22 can be prestressed by means of the tightening unit 40.

A cleaning arrangement 23 is assigned to the right conveying roller 21, whose functioning is later explained.

An expansion device 30 is arranged between the conveying rollers 21 and between the oncoming strand 22.2 and the departing strand 22.1. The expansion device 30 has a drive mechanism 31, which linearly displaces a pusher 32. On its end facing away from the drive mechanism 31, the pusher 32 has a die 33. The die 33 has a downward oriented die face 34. The die face 34 is designed to match the surface 12 to be imprinted of the workpiece 11 and is correspondingly curved.

During operation of the printing device, the transfer roller 24 is coated with the toner particles 27. If desired, the transfer rollers 28 are also coated with colored toner particles 27. The transfer rollers 24 and 28 rotate in a clockwise direction. However, the conveying rollers 21 rotate in a counterclockwise direction. Accordingly, the oncoming strand 22.2 is conducted from right to left past the transfer rollers 24 and 28. The circumferential speed of the rubber tape 22 and of the surfaces of the transfer rollers 24 and 28 are matched. Coronas 35 are used for transferring the toner particles 27. They transfer the toner particles 27 to the oncoming strand 22.2 of the rubber tape 22. The toner particles 27 are conveyed on the rubber tape 22 past the left conveying roller 21 and then come into the area of the departing strand 22.1. When the toner particles 27 which, for example represent a design, have arrived below the expansion device 30, the conveying roller 21 is stopped. The die 33 can then be displaced in the direction toward the workpieces 11 by means of the drive mechanism 31. During this the rubber tape 22 is stretched and comes to rest against the die face 34. The die 33 then presses the rubber tape 22 on the surface 12 to be imprinted. At the same time, the die 33 can advantageously also have a heating device, which achieves the fixing of the toner particles 27 in place on the workpiece surface.

Following the termination of the transfer of the toner particles 27, the die 33 is returned back into its upper initial position. The rubber tape 22 can then be further turned, for which purpose the conveying roller 21 is rotated.

At the same time the conveying device 10 also moves and places the next workpiece 11 underneath the expansion device 30. The workpiece 11 with the imprint is conveyed out of the area of action of the printing device.

The cleaning arrangement 23 is employed to prevent toner particles 27 which were not transferred to the workpiece 11 and therefore still adhere to the rubber tape 22 from spreading. For example, the cleaning arrangement 23 can be a heated roller which rolls off on the rubber tape 22. A brush is assigned to the heated roller, which removes the toner particles 27. The carrier surface of the rubber tape 22 can also have a silicon layer for preventing the toner particles 27 from spreading. It is also possible to apply a layer of silicon rubber to the rubber tape 22.

What is claimed is:

1. In a printing method having at least one transfer roller with a surface charged with a coating material wherein the coating material is applied to a carrier surface of a transfer element, and wherein the coating material is applied at least partially to a workpiece to be coated by the transfer element, the improvement comprising:

the transfer element including an expansion element (22) forming the carrier surface, and the carrier surface expandable by an expansion device (30) including a die (33) having a curved die face (34) that corresponds to a curved surface (12) of the workpiece (11).

2. In the printing method in accordance with claim 1, wherein the expansion element is a flat structure stretchable in one of one, two and three dimensions in at least a partial area of the carrier surface.

3. In the printing method in accordance with claim 2, wherein the transfer element (20) circulating as an endless tape is routed past the expansion device (30), and the endless tape is stopped during stretching of the carrier surface and performance of the printing process.

4. In the printing method in accordance with claim 2, wherein the transfer element (20) that circulates as an endless tape is routed past the expansion device (30), and the expansion device (30) and simultaneously the workpiece (11) are carried along with the endless tape during stretching the carrier surface and the performance of the printing process.

5. In the printing method in accordance with claim 1, wherein the transfer element (20) circulating as an endless tape is routed past the expansion device (30), and the endless tape is stopped during stretching of the carrier surface and performance of the printing process.

6. In the printing method in accordance with claim 1, wherein the transfer element (20) that circulates as an endless tape is routed past the expansion device (30), and the expansion device (30) and simultaneously the workpiece (11) are carried along with the endless tape during stretching the carrier surface and the performance of the printing process.

7. In a printing device with at least one transfer roller including a surface that can be charged at least partially with a toner to form an image, wherein the image is transferred to a carrier surface of an endless tape of a transfer element and imprinted to a workpiece, the improvement comprising:

an expansion device (30) including a die (33) for pressing the endless tape (22) against the workpiece (11), the workpiece (11) having a curved surface (12); and the die (33) including a curved die face (34) that matches the workpiece surface (12) to be imprinted.

8. The printing device in accordance with claim 7, wherein the endless tape is a rubber tape.

9. The printing device in accordance with claim 8, wherein the carrier surface of the endless tape (22) is pushed out of an expanded initial position against the surface (12) to be imprinted by the die (33).

10. The printing device in accordance with claim 7, wherein the die face (34) of the die (33) is made from an elastic, resilient material.

11. The printing device in accordance with claim 7, wherein a cleaning arrangement (23) is assigned to the transfer element by which the carrier surface of the endless tape (22) is cleaned after a printing process.

12. The printing device in accordance with claim 11, wherein the carrier surface of the endless tape (22) has a silicon coating or is formed by silicon rubber.

13. A printing device for applying images to workpieces, the printing device comprising:

at least one electrostatically chargeable transfer roller (24) including a surface that can be charged at least partially with a toner (26);

an endless tape (22) having a carrier surface, wherein the toner (26) can be applied to the carrier surface by the transfer roller (24); and an expansion device including a die (33) for pressing the endless tape (22) against each of the workpieces (11) and transferring the toner to a curved surface (12) of each workpiece (11), wherein the die (33) includes a curved die face (34) that correspondingly matches the work piece curved surface (12).

14. The printing device in accordance with claim 13, wherein the carrier surface of the endless tape (22) is pushed out of an expanded initial position against the surface (12) to be imprinted by the die (33).

15. The printing device in accordance with claim 13, wherein the die face (34) of the die (33) is made from an elastic, resilient material.

16. The printing device in accordance with claim 13, wherein a cleaning arrangement (23) is assigned to the transfer element by which the carrier surface of the expansion element (22) is cleaned after a printing process.

17. The printing device in accordance with claim 13, wherein the carrier surface of the endless tape (22) has a silicon coating or is formed by silicon rubber.

* * * * *